United States Patent [19]

Boen

[11] Patent Number: 4,873,698

[45] Date of Patent: Oct. 10, 1989

[54] INDUCTION FURNACE CRUCIBLE

[75] Inventor: Roger Boen, Pont Saint Esprit, France

[73] Assignee: Commissariat a l'Energie Atomique, Paris, France

[21] Appl. No.: 249,122

[22] Filed: Sep. 26, 1988

[30] Foreign Application Priority Data

Oct. 6, 1987 [FR] France ..... 87 13778

[51] Int. Cl.[4] ..... H05B 5/00

[52] U.S. Cl. ..... 373/156; 373/158

[58] Field of Search ..... 373/151–158

[56] References Cited

U.S. PATENT DOCUMENTS 3,461,215 8/1969 Reboux ..... 373/158
3,531,574 9/1970 Sterling et al. ..... 373/158
3,709,678 1/1973 Helary ..... 373/158 X

FOREIGN PATENT DOCUMENTS 0056915 8/1982 European Pat. Off. .
0079266 5/1983 European Pat. Off. .
866353 8/1953 Fed. Rep. of Germany .
21100378 7/1971 Fed. Rep. of Germany .

*Primary Examiner*—Roy N. Envall, Jr.
*Attorney, Agent, or Firm*—James E. Nilles; Donald C. McGaughey

[57] ABSTRACT

A crucible is disclosed for use in an induction furnace comprising a bottom wall and a circumferential sidewall. The sidewall comprises a plurality of vertically extending wall elements arranged parallel to each other. Each wall element has circumferentially spaced apart transverse faces and a duct means traversing therethrough in open communication between the spaced apart transverse surfaces. The duct means of each wall element are in aligned facing relation with the duct means of adjacent wall elements. An electrically insulating joint is interposed in sealing relation between each of the adjacent wall elements and having duct openings therethrough in open registry with the ducts presented by adjacent wall elements to form at least one channel interconnected between the crucible wall elements to carry a cooling liquid.

6 Claims, 3 Drawing Sheets

INDUCTION FURNACE CRUCIBLE

The present invention relates to a special construction of an induction furnace crucible made from an electrically conductive material, such as copper and which is externally surrounded by an induction coil.

The cylindrical wall of such crucibles is subject to significant heating both due to the molten charge which it surrounds and to the heat given off by the Joule effect as a result of the currents induced therein. It is therefore important to limit these heating effects by inserting cooling circuits into the wall interior. However, the need to limit the currents induced in said same wall which, apart from the heat losses which they cause, also bring about an electromagnetic decoupling between the coil and the charge means as the wall is constituted by an assembly of longitudinal sidewall elements having transverse faces, in the manner of the staves of a barrel, with an electrical insulating joint between two adjacent elements.

The transverse extension of these elements should be limited to the greatest possible extent, i.e. the angle covered by them, but this is limited by the minimum dimensions of the cooling ducts.

Figure 1:
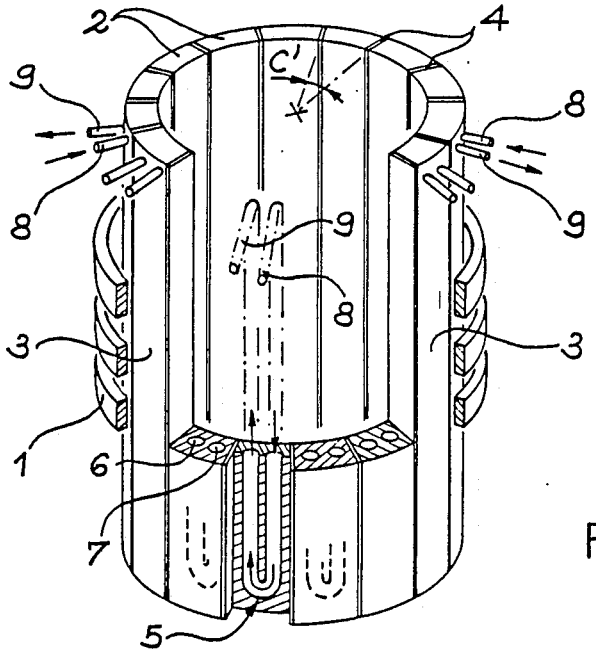
FIG. 1 PRIOR ART

FIG. 1 shows in perspective and part section one of the known crucibles. The inductor 1 is a coil wound around longitudinal elements 2 having a ring sector-shaped section covering an angle C'. They are assembled by their transverse faces 3 to form the cylindrical wall of a crucible, which also has a bottom, which is not shown in the drawing. The electrically insulating material joints are interposed between the adjacent elements 2 and are pressed between the transverse faces 3.

Each of the elements 2 contains a hydraulic cooling circuit, which is in the case a U-shaped duct 5 extending over the entire length thereof. One of its branches 6 communicates with a water supply pipe 8 and the other branch 7 with a water discharge pipe 9. The cooling water thus successively passes through the two branches 6 and 7 of the U-shaped duct 5.

In this case, the two branches 6, 7 are located on the same circumference, midway of the inner and outer surfaces of the cylindrical wall of the crucible. Thus, angle C'of elements 2 must be adequate to cover the two branches and is in this case 24°, where of it would be desirable for it to be as small as possible.

The problem is not fundamentally different if the two branches are placed at different depths of the wall and on the same radius, or if the U-shaped duct 5 was replaced by a vertical rectilinear duct with a supply pipe at the top and a discharge pipe at the bottom. The angle C' can only be slightly reduced as a result of this.

The invention makes it possible to obviate these disadvantages whilst overcoming the prejudice according to which the elements 2 must in each case be cooled by an independent circuit. It shows that it is possible to arrange circumferential cooling circuits and which in turn pass through several elements 2. Joints 4 are able to ensure the necessary sealing. Consequently it is possible to reduce the angle covered by elements 2 to previously unknown values of about 1°. The currents induced in the crucible are then negligible and considerable energy gains result.

The invention therefore relates to a crucible made from electrically conductive material of an induction furnace comprising longitudinal elements assembled together in accordance with their transverse faces via electrically insulating joints, characterized in that the elements are pierced by ducts issuing on to their transverse faces and onto identical ducts of the elements with which they are assembled and in that the joints are tight to the cooling liquids passing through the ducts.

The invention is described in greater detail hereinafter relative to non-limitative embodiments and the attached drawings, wherein show:

FIG. 1 already described, a prior art crucible.

Figure 2A:
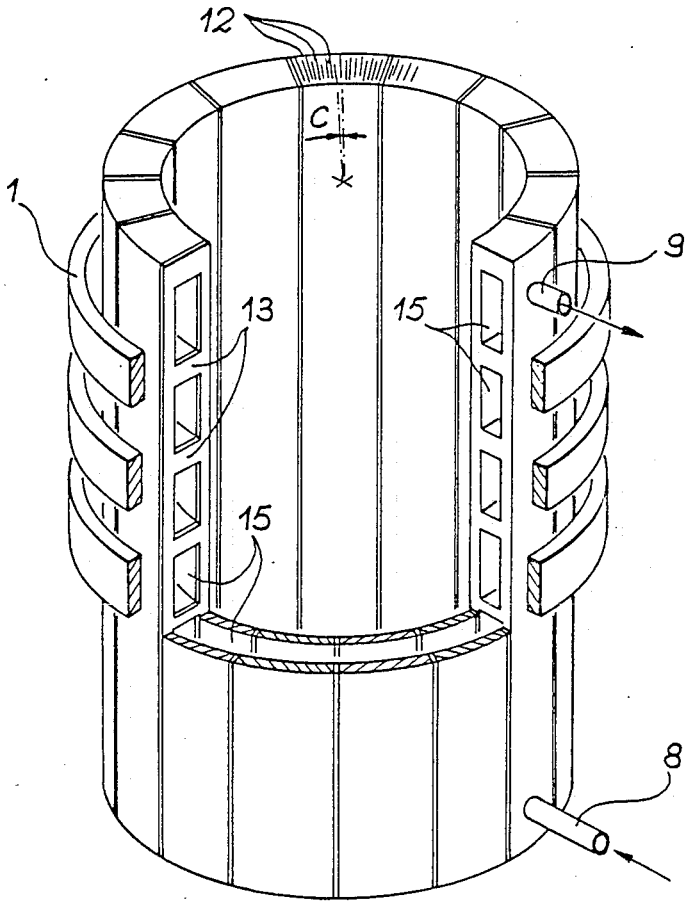

FIG. 2A a crucible according to the invention.

Figure 2B:
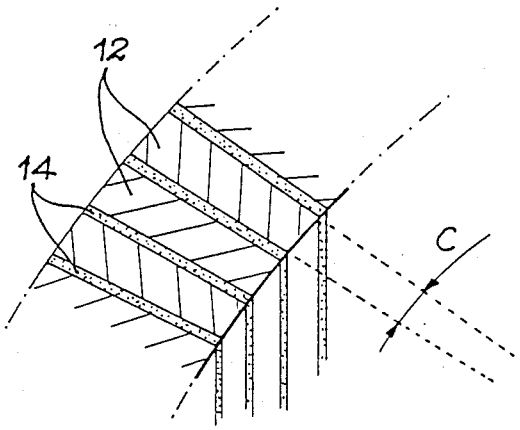

FIG. 2B a detail of FIG. 2A.

Figure 3:
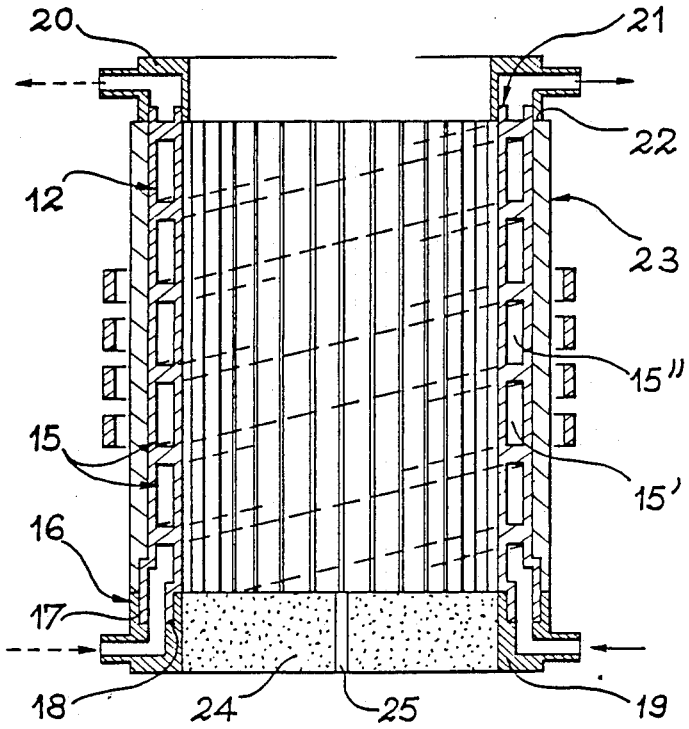
Figure 4:
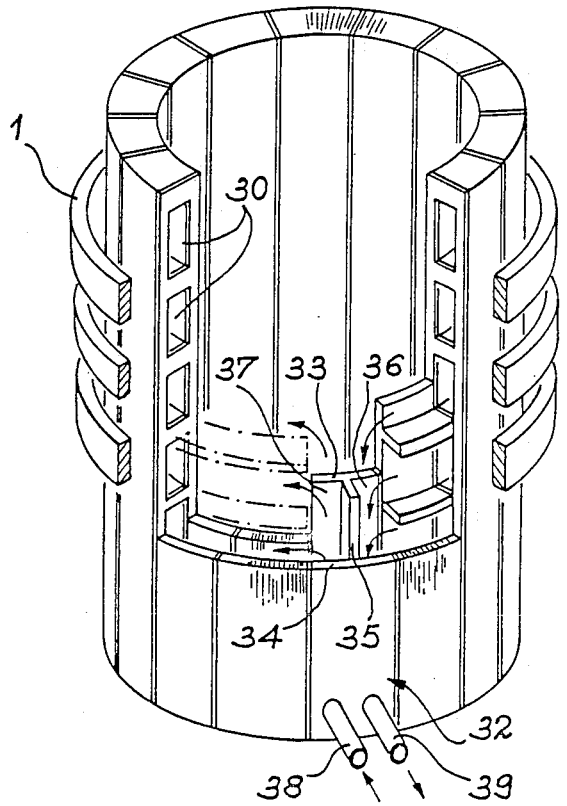
Figure 5:
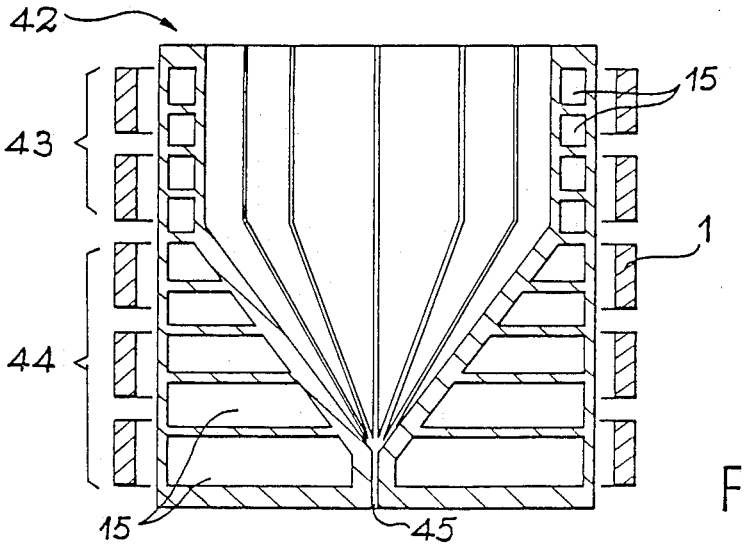

FIGS. 3, 4 and 5, three particular realizations of the invention.

The inductor 1 of FIGS. 2A and 2B is the same as in FIG. 1 and there are vertically longitudinal arranged sidewall elements 12 in the form of ring sectors covering an angle C much smaller than angle C' of FIG. 1 and approximately of 1° or 2°. It can be seen that elements 12 are thicker than their width between the transverse faces 13, so that the currents induced by inductor 1 cannot develop there and the electromagnetic losses, as well as the heating produced by them as a result of the Joule effect, are greatly reduced. Thus, the electrically insulating joints 14 are interposed, as hereinbefore, between adjacent longitudinal elements 12.

The main structural difference compared with FIG. 1 is that circumferential ducts 15, staged over the height of elements 12, transverse the latter and issue onto their lateral faces 13, where they are connected to the corresponding ducts 15 of adjacent elements 12 in order to form an overall hydraulic cooling network. Obviously, joints 14 must be perforated to provide duct openings between facing ducts 15 and at the same time prevent leaks between the cooling network and the exterior, i.e. ensuring the necessary sealing.

FIG. 3 shows a possible realization of the invention. The crucible wall is diametrically cut. Elements 12 have a lower heel 16 in the form of a projection 17 from their outer surface and a reentrant or recess 18 from their inner surface. The cooling network constituted by channels 15 in this case forms two imbricated helixes 15' and 15', each issuing at its lower end into a cylindrical water supply box 19 into which the reentrants 18 are fitted and at its upper end into a cylindrical water discharge box 20 fitted around the upper border 21 of elements 12.

The water discharge box 20 bears on the upper rim 22 of an enveloping ring 23 arranged around elements 12 and which bears on projections 17. It is made from an electrical insulant, such as fibre glass. The water boxes 19 and 20, as well as the enveloping ring 23, thus ensure the mechanical joining together of the longitudinal elements 14.

A refractory material bottom 24 provided with an orifice 25 for discharging the molten charge completes the device. It is placed in the centre of the water supply box 19 in the space defined by it. Obviously, ducts 15 can form a random number of helixes, which is only limited for ease of construction reasons.

FIG. 4 shows another possible realization of the invention, differing from that described hereinbefore in that the hydraulic circuit is on this occasion formed by several horizontal channels 30, each extending over a circumference of the cylindrical wall. A longitudinal element 32 of a particular shape is then provided and which optionally has a greater angular extension than the others, whose section is H-shaped and which thus has an inner wall 33, an outer wall 34 and a median crossmember 35 connecting the two walls 33, 34. The crossmember separates two vertical channels 36 and 37, one of them 36, to the right in the drawing, being traversed by the cooling water arriving from a supply pipe 38 and distributes said water into the horizontal channels 30, whilst the other 37, to the left in the drawing, collects the water which has passed through the horizontal channels 30 prior to discharging it by a discharge pipe 39.

A particular advantage of the invention is shown in FIG. 5. With the prior art ideas, it is not possible to correctly cool the narrowed parts of the crucible. However, longitudinal elements 42 having an upper cylindrical part 43 connecting to a lower part 44 which widens towards the bottom by the interior can be envisaged. The volume occupied by the molten charge is then cylindro-conical with the apex of the cone at the bottom and it issues onto a small diameter draining mouth 45 defined by lower parts 44. These longitudinal elements 12 have a much smaller width close to the draining mouth 45. However, it is possible to cool them at this point by progressively increasing the width (radial dimension) of the section of the cooling ducts 15 for those located at the bottom.

The arrangement of the ducts 15 in traversing channels consequently has the double interest of being able to reduce losses in the crucible by constructing same with finer and more numerous elements, or cooling the narrowed zones.

Obviously numerous other forms and constructions of these cooling channels can be conceived without passing beyond the scope of the invention defined by the claims.

I claim:

1. A crucible for use in an induction furnace comprising a bottom wall means;

a circumferential sidewall composed of a plurality of longitudinally extending sidewall elements (12) made from electrically conductive material, each of said sidewall elements having circumferentially spaced apart transverse faces and duct means traversing therethrough in open fluid communication between said spaced apart transverse faces, aid wall elements being arranged relative to each other to place said duct means of each wall in aligned open facing relation with said duct means of those wall elements that are adjacent thereto;

an electrically insulating joint interposed in sealing relation between each of said adjacent wall elements, each of said insulating joints having duct openings therethrough in open registry with said ducts presented by adjacent wall elements to form therewith at least one channel interconnected between said crucible wall elements for carrying a cooling liquid;

a cooling liquid supply means for admitting coolant into said channel; and a cooling liquid discharge means for discharging fluid from said channels.

2. A crucible according to claim 1, wherein said channel is helix-shaped.

3. A crucible according to claim 1, wherein a plurality of channels are provided, each of which is ring-shaped, and wherein each of said channels is in fluid communication with said cooling liquid means and said cooling liquid discharge means.

4. A crucible according to claim 3 wherein said cooling liquid supply means comprises a common supply pipe connected in fluid communication with all of said channels and said cooling liquid discharge means comprises a common discharge pipe connected in fluid communication with all of said channels.

5. A crucible according to claim 3, wherein the circumferential width between said transverse faces of said longitudinal wall elements is smaller than the thickness of said wall elements.

6. A crucible according to claim 3, wherein said bottom wall has a narrow part.

* * * * *